US011399567B2

(12) United States Patent
Liu

(10) Patent No.: US 11,399,567 B2
(45) Date of Patent: Aug. 2, 2022

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 237 days.

(21) Appl. No.: 16/870,863

(22) Filed: May 8, 2020

(65) Prior Publication Data

US 2021/0092998 A1 Apr. 1, 2021

(30) Foreign Application Priority Data

Sep. 26, 2019 (CN) ..... 201910918902.6
Sep. 26, 2019 (CN) ..... 201921618969.X

(51) Int. Cl.
*A24F 40/40* (2020.01)
*A24F 40/10* (2020.01)

(52) U.S. Cl.
CPC ..... *A24F 40/40* (2020.01); *A24F 40/10* (2020.01)

(58) Field of Classification Search
CPC ..... A24F 40/40; A24F 40/10
See application file for complete search history.

(56) References Cited

U.S. PATENT DOCUMENTS 10,477,899 B2 * 11/2019 Qiu ..... A24F 40/40
2015/0196055 A1 * 7/2015 Liu ..... A24F 40/50
131/329
2015/0245661 A1 * 9/2015 Milin ..... A24F 40/40
131/329
2017/0156408 A1 * 6/2017 Li ..... A24F 40/40
2018/0146707 A1 * 5/2018 Chen ..... A24F 40/42
2019/0159524 A1 * 5/2019 Qiu ..... A24F 40/485
2019/0274356 A1 * 9/2019 Deng ..... A24F 40/485
2019/0289913 A1 * 9/2019 Liu ..... A61M 11/042
2019/0350263 A1 * 11/2019 Qiu ..... A24F 40/49
2019/0364966 A1 * 12/2019 Liu ..... A24F 7/02
2020/0178614 A1 * 6/2020 Liu ..... A24F 7/02
2020/0187567 A1 * 6/2020 Liu ..... A24F 40/40
2022/0053834 A1 * 2/2022 Woods ..... A24F 40/46

* cited by examiner

*Primary Examiner* — Truc T Nguyen
(74) *Attorney, Agent, or Firm* — Matthias Scholl P.C.; Matthias Scholl

(57) ABSTRACT

An electronic cigarette including a mouthpiece assembly, an atomization assembly, and a base assembly. The mouthpiece assembly includes a first seal ring; a mouthpiece base; and a seal gasket. The atomization assembly includes a first fixing seat; a second seal ring; a glass tube; a third seal ring; a second fixing seat; an atomizer. The base assembly includes a fourth seal ring; a third fixing seat; a fifth seal ring; an annular ring; and a base. The first seal ring sleeves the mouthpiece base, and the mouthpiece base includes a cavity and the seal gasket is disposed in the cavity. The first fixing seat includes a first annular groove, and the first seal ring is disposed in the first annular groove; the second fixing seat includes a second annular groove, and the second seal ring is disposed in the second annular groove.

1 Claim, 6 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201910918902.6 filed Sep. 26, 2019 and to Chinese Patent Application No. 201921618969.X filed Sep. 26, 2019. The contents of all of the aforementioned applications, including any intervening amendments thereto, are incorporated herein by reference.

BACKGROUND

The disclosure relates to an electronic cigarette.

Electronic cigarettes atomize nicotine-containing e-liquid.

The atomizer of conventional electronic cigarettes is fixedly disposed.

SUMMARY

The disclosure provides an electronic cigarette comprising a mouthpiece assembly, an atomization assembly, and a base assembly; the mouthpiece assembly and the base assembly are disposed on two ends of the atomization assembly, respectively. The mouthpiece assembly comprises a first seal ring; a mouthpiece base; and a seal gasket. The atomization assembly comprises a first fixing seat; a second seal ring; a glass tube; a third seal ring; a second fixing seat; an atomizer. The base assembly comprises a fourth seal ring; a third fixing seat; a fifth seal ring; an annular ring; and a base.

The first seal ring sleeves the mouthpiece base, and the mouthpiece base comprises a cavity and the seal gasket is disposed in the cavity.

The first fixing seat comprises a first annular groove, and the first seal ring is disposed in the first annular groove; the second fixing seat comprises a second annular groove, and the second seal ring is disposed in the second annular groove; the first fixing seat and the second fixing seat are disposed on two ends of the glass tube, respectively, and are connected to each other; the second fixing seat comprises a cavity, and the atomizer is fixed in the cavity, the first fixing seat is in threaded connection to the mouthpiece base.

Two ends of the third fixing seat are provided with two grooves, and the fourth seal ring and the fifth seal ring are disposed in the two grooves, respectively; the base is directly connected to the third fixing seat; the third fixing seat comprises a side wall provided with a plurality of ventilation holes, and the annular ring encircles the third fixing seat and comprises a plurality of through holes; the third fixing seat is in threaded connection to the second fixing seat.

DETAILED DESCRIPTION

To further illustrate, embodiments detailing an electronic cigarette are described below. It should be noted that the following embodiments are intended to describe and not to limit the disclosure.

Figure 1:
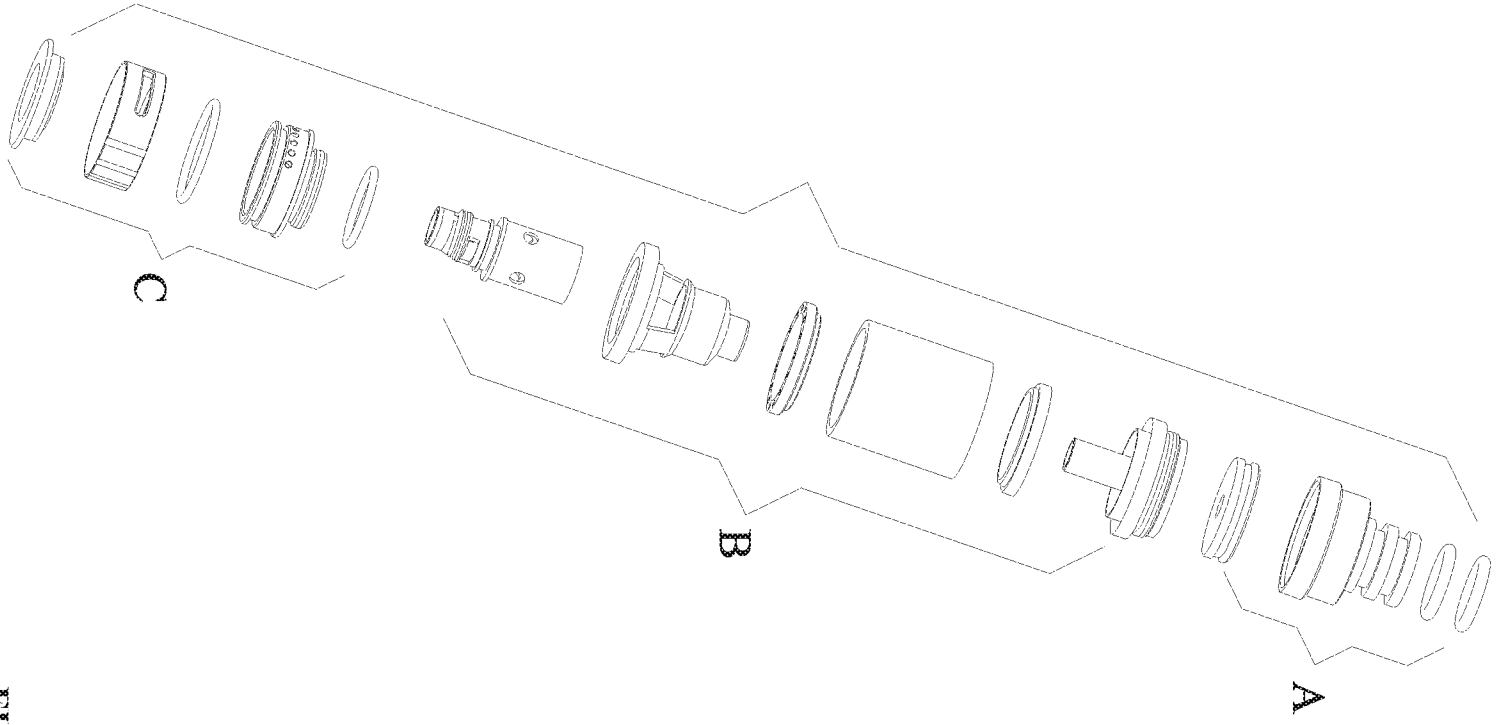
FIG. 1 is an exploded view of an electronic cigarette according to one embodiment of the disclosure.
Figure 2:
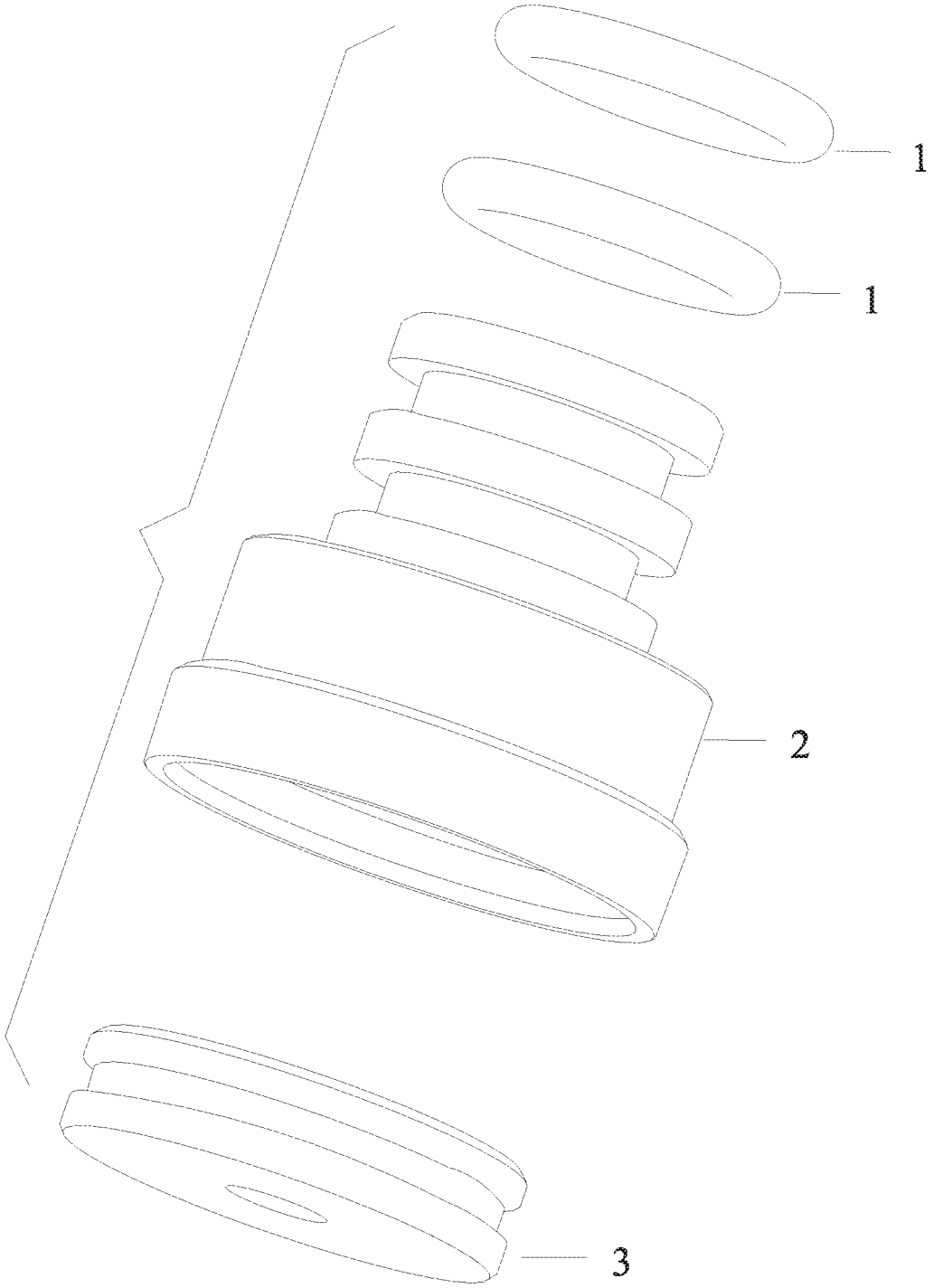
FIG. 2 is an exploded view of a mouthpiece assembly of an electronic cigarette according to one embodiment of the disclosure.
Figure 3:
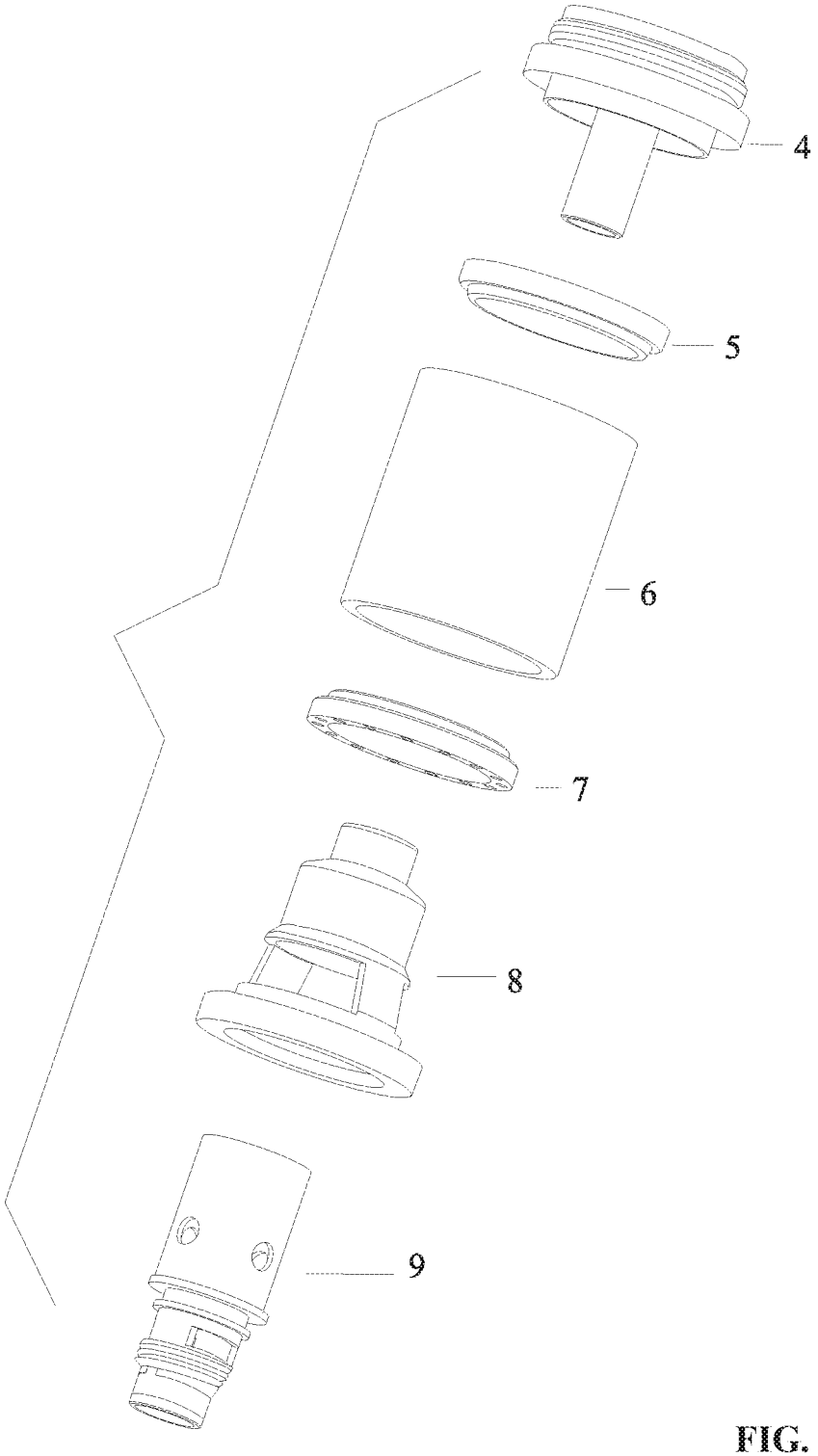
FIG. 3 is an exploded view of an atomization assembly of an electronic cigarette according to one embodiment of the disclosure.
Figure 4:
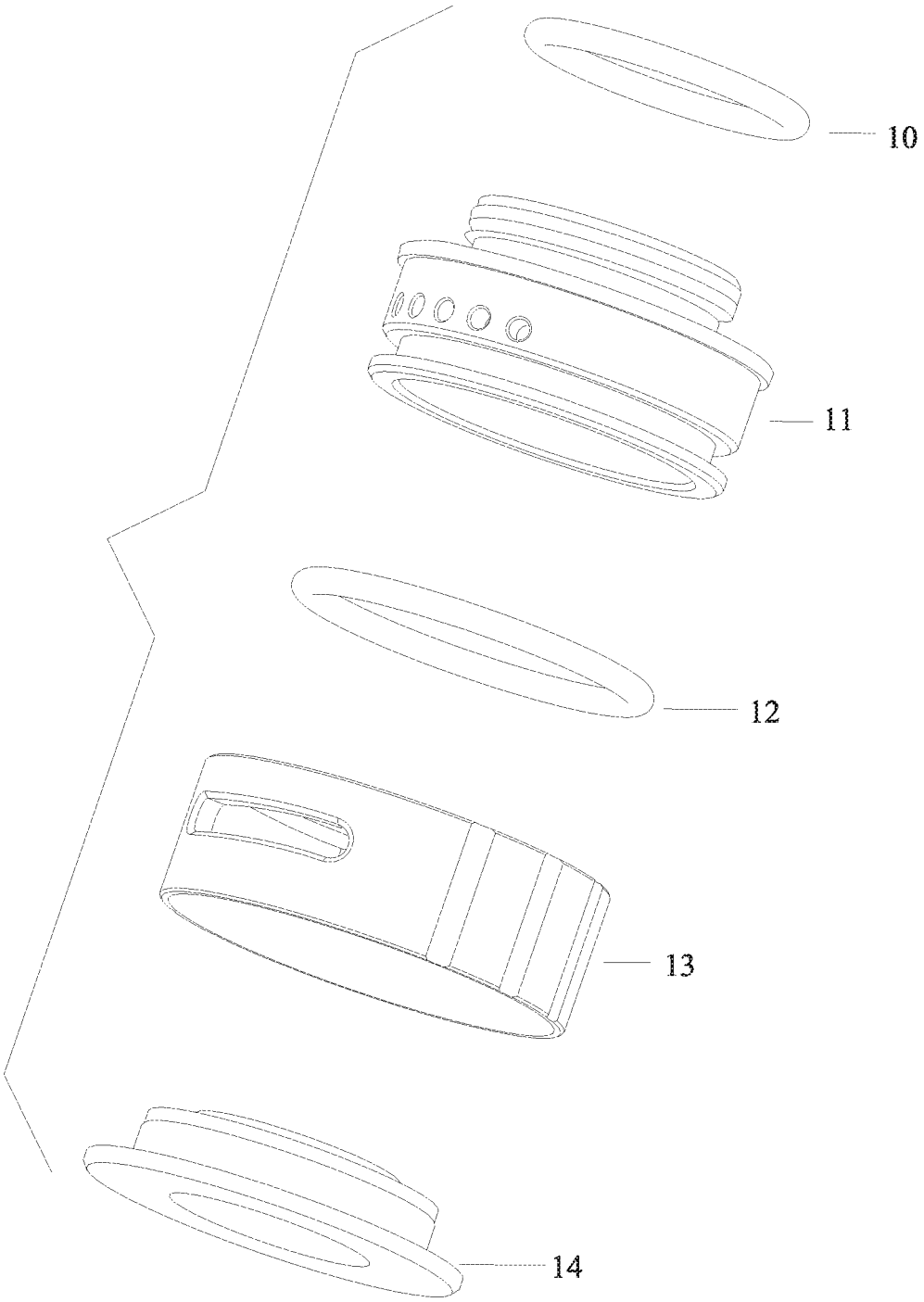
FIG. 4 is an exploded view of abase assembly of an electronic cigarette according to one embodiment of the disclosure.
Figure 5:
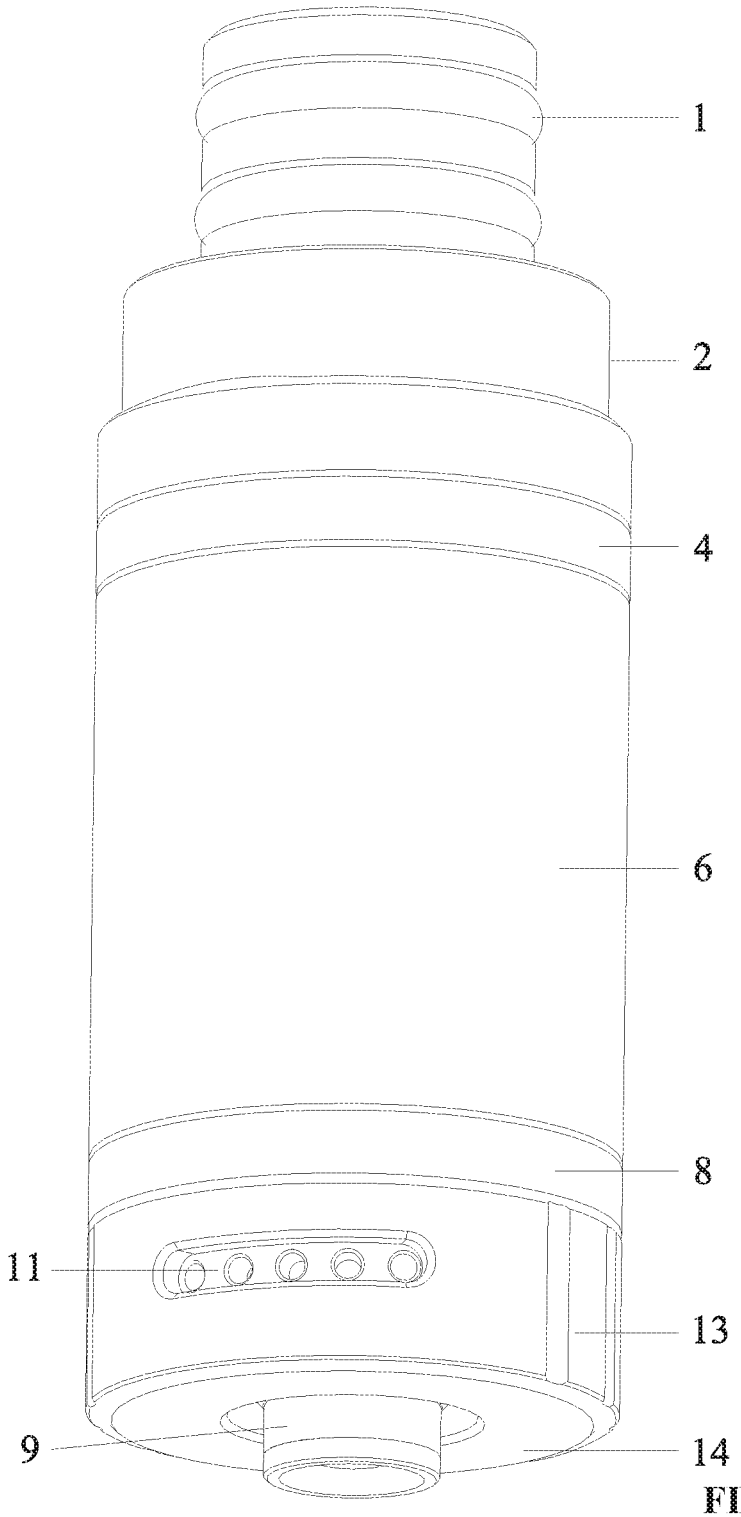
FIG. 5 is a stereogram of an electronic cigarette according to one embodiment of the disclosure.
Figure 6:
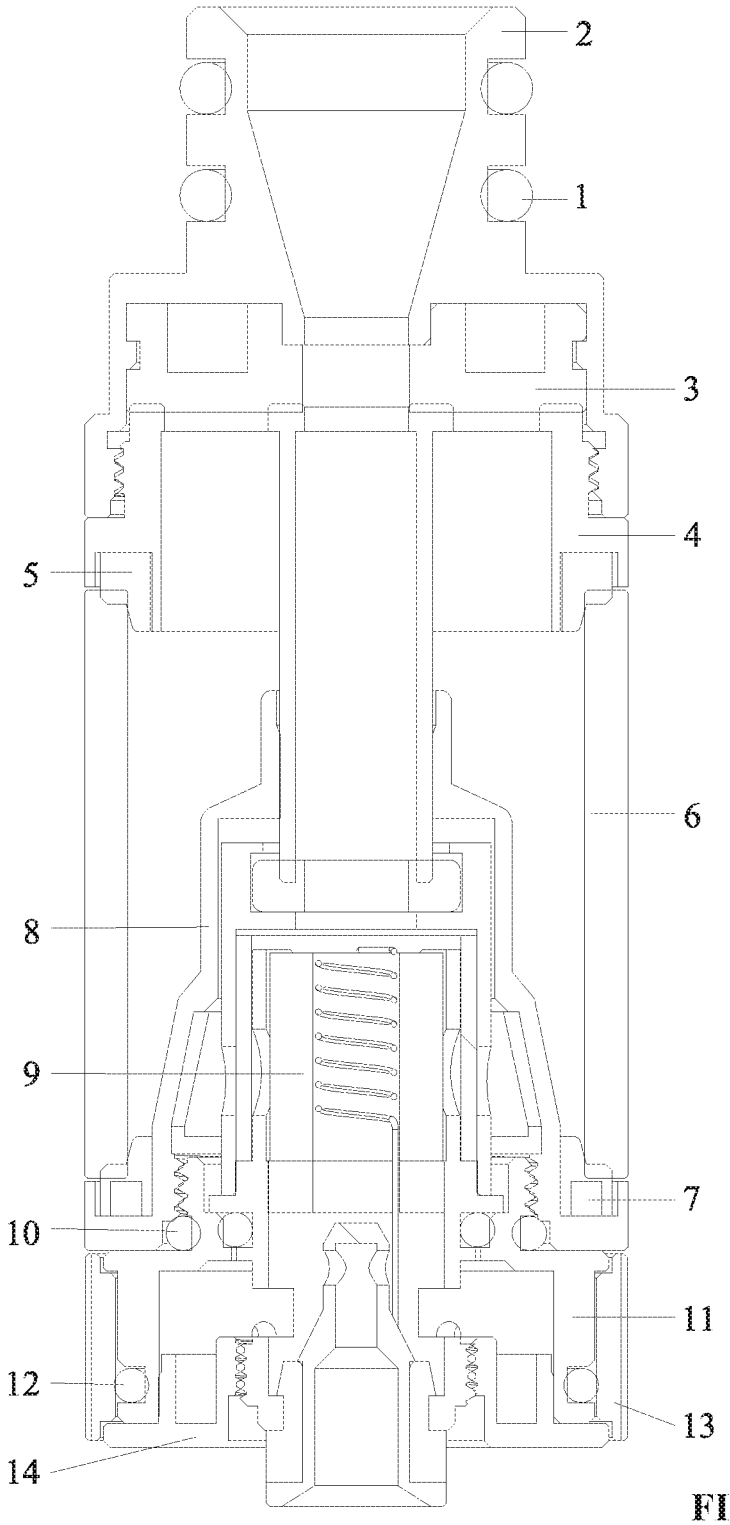
FIG. 6 is a sectional view of an electronic cigarette according to one embodiment of the disclosure.

As shown in FIGS. 1-6, an electronic cigarette comprises a mouthpiece assembly A, an atomization assembly B. and a base assembly C. The mouthpiece assembly A and the base assembly C are disposed on two ends of the atomization assembly B, respectively.

The mouthpiece assembly A comprises a first seal ring 1; a mouthpiece base 2; and a seal gasket 3. The first seal ring 1 sleeves the mouthpiece base 2, and the mouthpiece base 2 comprises a cavity and the seal gasket 3 is disposed in the cavity.

The atomization assembly B comprises a first fixing seat 4; a second seal ring 5; a glass tube 6; a third seal ring 7; a second fixing seat 8; an atomizer 9. The first fixing seat 4 comprises a first annular groove, and the first seal ring 5 is disposed in the first annular groove; the second fixing seat 8 comprises a second annular groove, and the second seal ring 7 is disposed in the second annular groove; the first fixing seat 4 and the second fixing seat 8 are disposed on two ends of the glass tube 6, respectively, and are connected to each other; the second fixing seat 8 comprises a cavity, and the atomizer 9 is fixed in the cavity.

The mouthpiece base 2 is in threaded connection to the first fixing seat 4. The e-liquid inlet of the atomization assembly is sealed by the seal gasket 3. In inhaling, the mouthpiece assembly is pressed on the atomization assembly, and thus the e-liquid inlet is completely sealed, preventing the leakage of the e-liquid. The mouthpiece base 2 communicates with the atomizer 9, which can trigger the operation of the pneumatic switch under the cooperation of the battery.

The base assembly C comprises a fourth seal ring 10; a third fixing seat 11; a fifth seal ring 12; an annular ring 13; and a base 14. Two ends of the third fixing seat 11 are provided with two grooves, and the fourth seal ring 10 and the fifth seal ring 12 are disposed in the two grooves, respectively; the base 14 is directly connected to the third fixing seat 11; the third fixing seat 11 comprises a side wall provided with a plurality of ventilation holes, and the annular ring 13 encircles the third fixing seat 11; the third fixing seat 11 is in threaded connection to the second fixing seat 8.

The atomizer 9 is in threaded connection to the third fixing seat 11. When the atomizer 9 breaks down, the base assembly is unscrewed, and the atomizer 9 is replaced. The third fixing seat 11 comprises a plurality of ventilation holes, and the annular ring 13 encircles the third fixing seat 11 and comprises a plurality of through holes. By rotating the annular ring 13 to match the ventilation holes and the through holes as needed, the vapor amount can be adjusted.

It will be obvious to those skilled in the art that changes and modifications may be made, and therefore, the aim in the appended claims is to cover all such changes and modifications.

What is claimed is:

1. A device, comprising: a mouthpiece assembly, an atomization assembly, and a base assembly; the mouthpiece assembly and the base assembly being disposed on two ends of the atomization assembly, respectively;

the mouthpiece assembly comprising:

1) a first seal ring;

2) a mouthpiece base; and 3) a seal gasket;

the atomization assembly comprising:

1) a first fixing seat;

2) a second seal ring;

3) a glass tube;

4) a third seal ring;

5) a second fixing seat; and 6) an atomizer;

the base assembly comprising:

1) a fourth seal ring;

2) a third fixing seat;

3) a fifth seal ring;

4) an annular ring; and 5) a base;

wherein:

the first seal ring sleeves the mouthpiece base, and the mouthpiece base comprises a cavity and the seal gasket is disposed in the cavity;

the second seal ring is disposed on a bottom side of the first fixing seat; the third seal ring is disposed on an end of the second fixing seat; the first fixing seat and the second fixing seat are disposed on two ends of the glass tube, respectively; the second fixing seat comprises a cavity, and the atomizer is fixed in the cavity; the first fixing seat is in threaded connection to the mouthpiece base; and the fourth seal ring and the fifth seal ring are disposed on a top end and a bottom end of the third fixing seat, respectively; the base is directly connected to the third fixing seat; the third fixing seat comprises a side wall provided with a plurality of ventilation holes, and the annular ring encircles the third fixing seat and comprises a plurality of through holes; the third fixing seat is in threaded connection to the second fixing seat.

* * * * *